United States Patent [19]

Meyer

[11] Patent Number: 4,884,424

[45] Date of Patent: Dec. 5, 1989

[54] MORTISE CYLINDER LOCK GUARD

[76] Inventor: David R. Meyer, 8610 NW. 21st Ct., Sunrise, Fla. 33322

[21] Appl. No.: 347,340

[22] Filed: May 4, 1989

[51] Int. Cl.[4] ..... E05B 17/14

[52] U.S. Cl. ..... 70/427; 70/160

[58] Field of Search ..... 70/427, 423, 424, 425, 70/426, 428, 158-162

[56] References Cited

U.S. PATENT DOCUMENTS

| | | | |
|---|---|---|---|
| 3,477,201 | 11/1969 | Siana | 70/427 |
| 3,714,804 | 11/1971 | French . | |
| 4,070,882 | 1/1978 | Ruiz . | |
| 4,227,388 | 10/1980 | Nigrelli | 70/427 |
| 4,254,888 | 3/1981 | Chandler . | |
| 4,631,938 | 12/1986 | Johnson . | |
| 4,665,728 | 5/1987 | Azzara | 70/427 |
| 4,732,024 | 3/1988 | Nagy . | |
| 4,777,812 | 10/1988 | Haugen . | |

OTHER PUBLICATIONS

U.S. Lock Corp. Catalog pages, 1988.

*Primary Examiner*—Robert L. Wolfe

[57] ABSTRACT

A mortise cylinder lock guard for providing protection to a mortise cylinder lock when installed in a door includes a collar for situating between a front face of the lock and the door and substantially surrounding the lock at an outer periphery thereof. A cover is attached to the collar to substantially cover and prevent access to a keyhole of the lock. A hinge attaches the collar and the cover together to allow the cover to be moved between an open and a closed position, the open position permitting access to the keyhole and the closed position preventing access to the keyhole. A hasp is coupled to the collar and the cover for permitting locking of the cover in a closed position by use of a padlock.

7 Claims, 1 Drawing Sheet

MORTISE CYLINDER LOCK GUARD

BACKGROUND

1. Field of the Invention

This invention relates generally to the field of lock guards. More particularly, this invention relates to a lock guard for a mortise cylinder or rim cylinder type lock which prevents vandalism of the lock while doubling as a wrenchproof collar for the lock.

2. Background of the Invention

The mortise cylinder type lock has become very popular for the security it provides to stores, offices and other places of business. A similar type lock known as the rim cylinder and similar lock structures will also be refered to herein generically as a mortise cylinder lock. It is also a popular lock for home use. Such locks are commercially available widely by manufacturers such as Medeco and AcroWelch.

While providing a high degree of security, this type of lock is vulnerable to vandalism. Such locks are frequently vandalized by squirting glue such as the so called 'superglues' (cyanoacrylate glues) or plastic model glues into the key hole rendering the lock useless. In addition to the obvious costs of replacement of locks for such vandalism, they also can prevent a merchant from opening his place of business, thus costing the merchant lost revenues.

The present invention provides a remedy to this problem which allows for quick entry after such a vandalism while limiting losses to a simple inexpensive padlock or equivalent in most instances.

SUMMARY OF THE INVENTION

It is an object of the present invention to provide an improved guard for a mortise cylinder lock.

It is another object of the present invention to provide such a guard which provides enhanced security to the premise being protected by the mortise cylinder lock.

It is a further object of the present invention to provide such a guard which doubles as a so-called 'wrenchproof' collar.

It is an advantage of the invention that losses due to vandalism are minimized and security is enhanced.

These and other objects and advantages of the invention will become apparent to those skilled in the art upon consideration of the following description of the invention.

In one embodiment of the present invention, a mortise cylinder lock guard for providing protection to a mortise cylinder lock when installed in a door includes a collar for situating between a front face of the lock and the door and substantially surrounding the lock at an outer periphery thereof. A cover is attached to the collar to substantially cover and prevent access to a keyhole of the lock. A hinge attaches the collar and the cover together to allow the cover to be moved between an open and a closed position, the open position permitting access to the keyhole and the closed position preventing access to the keyhole. A hasp is coupled to the collar and the cover for permitting locking of the cover in a closed position by use of a secondary lock such as a padlock.

The features of the invention believed to be novel are set forth with particularity in the appended claims. The invention itself, however, both as to organization and method of operation, together with further objects and advantages thereof, may be best understood by reference to the following description taken in conjunction with the accompanying drawing.

DETAILED DESCRIPTION OF THE INVENTION

Figure 1:
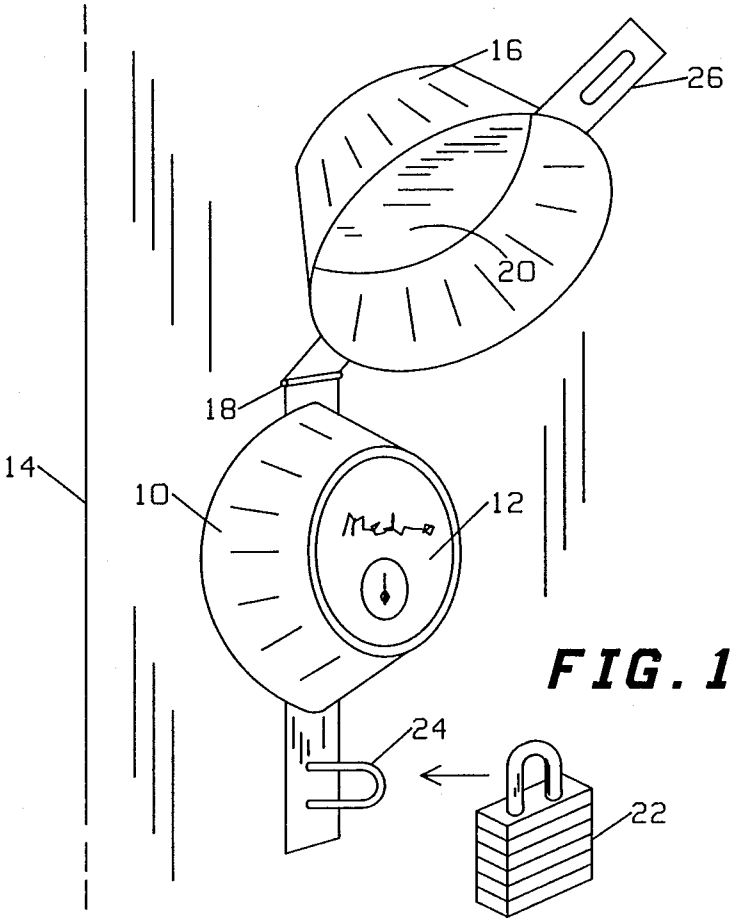
FIG. 1 shows an embodiment of the mortise cylinder guard of the present invention in the open (unlocked) position.

Turning now to the drawing in which like reference numerals designate corresponding parts throughout the several figures thereof, and in particular to FIG. 1, an embodiment of the present mortise cylinder lock guard in the open position. The mortise cylinder lock guard of the present invention includes a collar 10 which is similar to a conventional wrench-proof collar or spacer for a mortise cylinder lock. The collar 10 is placed between a mortise cylinder lock 12 and the surface of the door 14 to be locked. The collar 10, as will be understood by those skilled in the art, is somewhat tapered with the larger diameter adjacent the door to make it difficult to grip with a wrench. The collar is also loosely fitted to the cylinder in such a manner to allow it to spin about the cylinder if grasped successfully by a wrench so that the lock cylinder is protected from damage. The collar 10 is held in place typically by a flange surrounding the outer face of the mortise cylinder lock 12 which is larger in diameter than the diameter of the outermost opening of the collar 10.

A cover 16 is attached to the collar 10 by a hinge 18 at the upper side thereof to allow the cover to be opened or closed over the mortise cylinder lock 12. The cover 16 is preferably substantially the same shape as the collar only slightly larger to fit thereover. The cover of this embodiment has a flat circular plate 20 to cover the mortise cylinder lock when closed. The cover 16 and collar 10 are fitted with a hasp for accepting a conventional padlock 22 such as those widely available from Master Lock Company and others. Of course, those skilled in the art will recognize that other secondary locking mechanisms may also advantageously be used (for example, locks similar to the ABUS Diskus Padlock, the American Superlock, cable locks, locking hasps and other similar designs may be adapted to substitute for the simple hasp and padlock arrangement of the preferred embodiment.).

In this embodiment, the collar 10 is fitted with the male portion 24 of the hasp lock while the cover 16 is fitted with the female portion 26 of the hasp lock.

Figure 2:
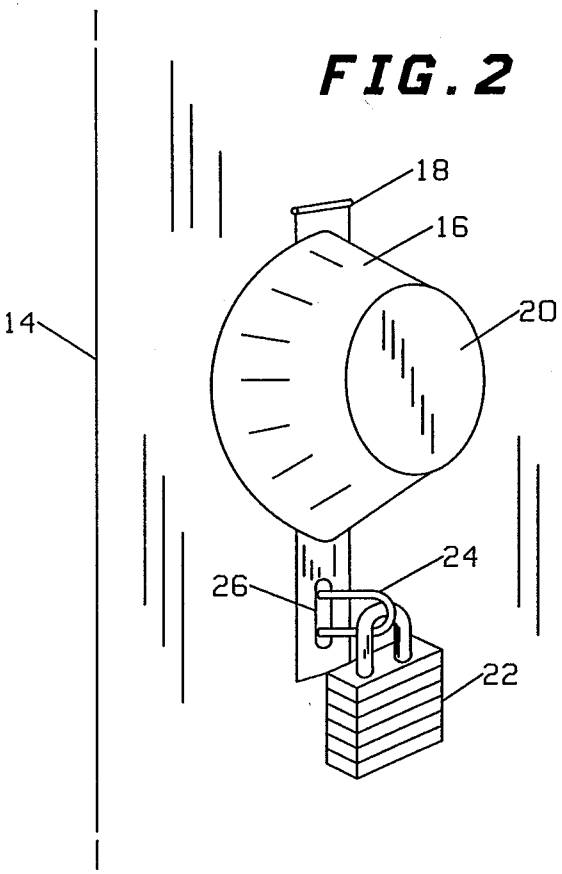
FIG. 2 shows the embodiment of FIG. 1 in the closed position.

When in the open position as shown in FIG. 1, the mortise cylinder lock is readily accessible for entry of a key to unlock or lock the mortise cylinder lock. FIG. 2 shows the mortise cylinder lock guard of the present invention in the closed position showing that the mortise cylinder lock 12 is inaccessible to a vandal or a lock picker. The hasp lock is closed and locked with a padlock 22 or equivalent to provide an additional level of locking and to prevent vandalism to the more expensive and difficult to replace mortise cylinder lock 12.

It is noted that the padlock 22 is, of course, vulnerable to attack by vandals in this arrangement. However, padlocks are easily removed by conventional bolt cutters in the event it is vandalized to allow relatively quick access to the primary locking mechanism of the mortise cylinder lock 12. The padlock is then easily replaced. Since vandals are generally concerned only with creating mischief when they glue locks, they are seldom prepared to remove a padlock to access a more expensive lock since that requires either lock picking skills or relatively heavy tools. The additional security provided by the double locking will, of course, be unlikely to deter a determined thief. But, the additional level of locking may slow down a thief enough to make capture somewhat more likely.

In alternative embodiments of the present inventions, other hasp arrangements may be used. For example, a hasp structure with an integral lock similar to a bicycle cable lock or a locking hasp may be used. Of course, each such embodiment may have particular advantages or drawbacks which make it particularly suitable for a particular application.

The present mortise cylinder lock guard may be made of any of a variety of materials to appropriately match the lock or door hardware as required. For example, it may be made of brass to match typical home installations or may be made of hardened steel for storefront applications. The material selection will depend upon cost and security level desired as well as aesthetic factors.

Those skilled in the art will appreciate that many variations of the present invention are possible without departing from the basic invention. For example, the outer configuration of the collar and cover may be altered to a more rectangular or oval shape if desired. Other obvious variations will occur to those skilled in the art.

Thus it is apparent that in accordance with the present invention, an improved apparatus and method that fully satisfies the objectives, aims and advantages is set forth above. While the invention has been described in conjunction with specific embodiments, it is evident that many alternatives, variations, modifications and permutations will become apparent to those skilled in the art in light of the foregoing description. Accordingly, it is intended that the present invention embrace all such alternatives, variations, modifications and permutations as fall within the spirit and broad scope of the appended claims.

What is claimed as new and desired to be secured by Letters Patent is:

1. A mortise cylinder lock guard for providing protection to a mortise cylinder lock when installed in a door, comprising in combination:

collar means for situating between a front face of said lock and said door and substantially surrounding said lock at an outer periphery thereof;

cover means, attached to said collar mean to substantially cover and prevent access to a keyhole of said lock;

hinging means for attaching said collar means and said cover means together to allow said cover means to be moved between an open and a closed position, said open position permitting access to said keyhole and said closed position preventing access to said keyhole; and hasping means, coupled to said collar means and said cover means, for permitting locking of said cover means in said closed position by use of a secondary locking means.

2. The apparatus of claim 1, wherein said cover means is held in place by a flange situated on said lock.

3. The apparatus of claim 2, wherein said cover may spin about said lock.

4. The apparatus of claim 1, wherein said collar means includes tapered sides surrounding said lock to make grasping of said collar with a wrench difficult.

5. The apparatus of claim 1, wherein said hasping means includes a male hasp member attached to said collar means and a mating female hasp member attached to said cover means.

6. The apparatus of claim 1, wherein said secondary locking means includes a padlock.

7. A mortise cylinder lock guard for providing protection to a mortise cylinder lock when installed in a door, comprising in combination:

collar means for situating between a front face of said lock and said door and substantially surrounding said lock at an outer periphery thereof and held in place by a flange situated on said lock so that said collar means may spin about said lock;

said collar means including tapered sides to make it difficult to grasp said collar with a wrench;

cover means, attached to said collar means to substantially cover and prevent access to a keyhole of said lock;

hinging means for attaching said collar means and said cover means together to allow said cover means to be moved between an open and a closed position, said open position permitting access to said keyhole and said closed position preventing access to said keyhole; and hasping means, coupled to said collar means and said cover means, for permitting locking of said cover means in said closed position by use of a padlock, said hasping means including a male hasp member attached to said collar means and a mating female hasp member attached to said cover means.

* * * * *